US005811892A

United States Patent [19]

Battles et al.

[11] Patent Number: 5,811,892

[45] Date of Patent: Sep. 22, 1998

[54] POWER SUPPLY SYSTEM INCLUDING MECHANICAL OUTPUT SWITCHES FOR USE WITH A PLURALITY OF DISPLAY TUBES

[75] Inventors: Timothy J. Battles, Mequon, Wis.; Robert Iannini, Mt. Vernon, N.H.

[73] Assignee: KCS Industries, Inc., Hartland, Wis.

[21] Appl. No.: 735,024

[22] Filed: Oct. 22, 1996

[51] Int. Cl.[6] ..... H01H 19/14; H01H 35/00

[52] U.S. Cl. ..... 307/115; 307/119; 307/125; 307/129; 307/132 R; 307/141; 307/157; 361/166; 361/167; 361/191; 315/210; 315/226; 335/206

[58] Field of Search ..... 315/209 R, 210, 315/226; 361/167, 166, 191; 335/205, 206; 307/112, 113, 115, 116, 119, 125, 129, 130, 131, 132 R, 132 E, 139, 140, 141.4, 141.8, 157

[56] References Cited

U.S. PATENT DOCUMENTS

| | | | |
|---|---|---|---|
| 3,721,929 | 3/1973 | Gabriel et al. | 335/206 |
| 3,925,704 | 12/1975 | Camic | 315/200 A |
| 4,441,055 | 4/1984 | Balchjunas et al. | 315/288 |
| 4,554,462 | 11/1985 | Komiya et al. | 307/140 |
| 4,645,979 | 2/1987 | Chow | 315/169.1 |
| 4,678,450 | 7/1987 | Scolari et al. | 446/405 |
| 4,933,612 | 6/1990 | Bonin | 315/307 |
| 5,023,516 | 6/1991 | Ito et al. | 315/101 |
| 5,089,745 | 2/1992 | Iannini | 315/76 |
| 5,138,235 | 8/1992 | Sun et al. | 315/209 R |
| 5,208,515 | 5/1993 | Lee | 315/225 |
| 5,220,247 | 6/1993 | Moisin | 315/209 R |
| 5,270,619 | 12/1993 | Iannini | 315/248 |
| 5,325,024 | 6/1994 | Piejak et al. | 315/248 |

OTHER PUBLICATIONS

"Power Electronics" Devices, Drivers, Applications and Passive Components by B.W. Williams, McGraw–Hill, Inc., 1992, pp. 245–246.

*Primary Examiner*—William M. Shoop, Jr.
*Assistant Examiner*—Jonathan S. Kaplan

[57] ABSTRACT

A low voltage power inverter utilizes reed switches to control a number of display tubes. The reed switches are controlled by magnetic coils or permanent magnets. The magnetic coils receive a control signal from a control circuit. The control circuit is powered by a capacitor coupled around a power lead and a capacitor coupled around a return lead. The permanent magnet is coupled to a mechanical actuator.

16 Claims, 4 Drawing Sheets

POWER SUPPLY SYSTEM INCLUDING MECHANICAL OUTPUT SWITCHES FOR USE WITH A PLURALITY OF DISPLAY TUBES

FIELD OF THE INVENTION

The present invention relates generally to systems including gaseous filled display tubes, and more particularly to a power supply for powering the gaseous filled display tubes.

BACKGROUND OF THE INVENTION

Gaseous filled display tubes such as neon or argon tubes or other display devices emit light when subject to a high voltage (display) signal. Generally, smaller display tubes (display tubes with lengths less than 10 feet) may be powered by a power supply such as a low voltage inverter which transforms low voltage direct current (VDC) input power into a high frequency, high voltage display signal. Alternatively, a low voltage inverter utilizing a transformer can convert low voltage DC input power to a high voltage, low frequency display signal such as a 60 Hz display signal. The low voltage DC input power can be produced by a standard household AC line provided through a rectifier circuit, a battery or other DC power source. In another alternative, higher power inverters can utilize line voltage (110 VAC) to generate the display signal.

Display systems can include a number of display tubes. Generally, selected tubes in the display system are individually turned ON and OFF to provide animated effects or synchronous images. Heretofore, each display tube was powered by its own inverter circuit or its own transformer, and display tubes were turned ON and OFF by enabling and disabling the inverter associated with the particular tube or the transformer associated with the particular tube. Inverters were enabled or disabled in response to an external or internal control signal or external switches.

Thus, there is a need for a power supply capable of controlling the display signal to a number of display tubes making use of a single low voltage inverter having only one transformer. The power supply should allow each of the display tubes to be turned ON and OFF individually, either automatically or in response to an external electronic or mechanical signal. Preferably, a mechanical or electronic control circuit turns the tubes ON and OFF without the need for a separate power supply or batteries.

SUMMARY OF THE INVENTION

The present invention relates to a power supply for use with a plurality of display tubes. The power supply includes a low voltage inverter, a plurality of mechanical switches, and a control circuit. The low voltage inverter is coupled to a plurality of display tubes and provides a display signal to the tubes. Each mechanical switch is coupled to a display tube. The operation of each mechanical switch determines whether the display signal is applied to the display tube to which the switch is coupled. The control circuit is coupled to the low voltage inverter and the mechanical switches. The control circuit activates each of the mechanical switches to turn the display tubes ON and OFF.

The present invention also relates to a power supply including a low voltage inverter, a plurality of mechanical switches, and a magnetic device. The low voltage inverter is coupled to a plurality of display tubes and provides a display signal to the tubes. Each mechanical switch is coupled to a display tube. The operation of each mechanical switch determines whether the display signal is applied to the display tube to which the switch is coupled. The magnetic device is disposed proximate the switches. The magnetic device activates each of the mechanical switches.

The present invention further relates to a voltage inverted power supply for use with a first display tube and a second display tube. The power supply includes a transformer having a secondary with a first terminal and a second terminal. The first display tube is coupled in series with the second display tube. The first display tube is coupled to the first terminal, and the second display tube is coupled to the second terminal. The power supply also includes a first reed switch coupled in parallel with the first display tube, a second reed switch coupled in parallel with the second display tube and a control circuit magnetically coupled to the first reed switch and the second reed switch. The display signal is provided from the secondary of the transformer to the first display tube or the second display tube. The control circuit operates to OPEN and CLOSE the first reed switch or the second reed switch, thereby turning ON and OFF the first display tube or the second display tube.

The present invention advantageously provides a power supply using a single voltage inverter (e.g., low power or higher power) for a plurality of display tubes. The control circuit is preferably configured to draw power from the high voltage leads associated with the display signal and to operate without external input, thereby allowing the design to be completely self-contained except for the high-voltage leads. The control circuit may be programmed to provide different effects as required. Alternatively, the control circuit is preferably designed to allow manual or mechanical control of the display signal to the display tubes.

It is also desirable for the application of the display signal to the display tube to be controlled magnetically, thereby allowing coils or movable magnets to be used in the switching controls. The magnets may be mechanically coupled to actuators which can be manually adjusted.

BRIEF DESCRIPTION OF THE DRAWINGS

Preferred embodiments of the invention will hereafter be described with reference to the accompanying drawings, wherein like numerals denote like elements, and.

DETAILED DESCRIPTION OF THE EXEMPLARY EMBODIMENTS

Figure 1:
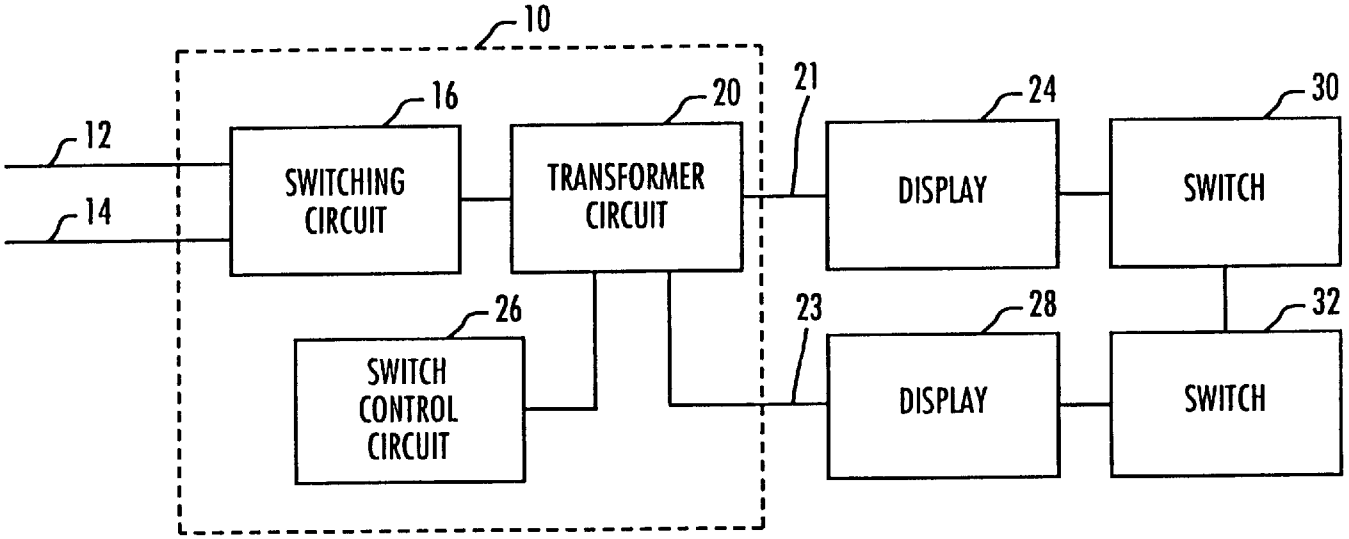
FIG. 1 is a block diagram of a power supply system for a plurality of display tubes in accordance with exemplary embodiments of the present invention.

FIG. 1 is a schematic block diagram of a low voltage power inverter 10 including a switching circuit 16, a transformer circuit 20, and a switch control circuit 26. Low voltage power inverter 10 is coupled to gaseous filled display tubes 24 and 28 such as neon or argon display tubes. Alternatively, display tubes 24 and 28 can be gas filled novelty devices such as those discussed in U.S. Pat. No. 5,270,619 issued Dec. 14, 1993, assigned to the assignee of the present invention, or any appliance which emits light in response to a high voltage signal. Preferably, display tubes 24 and 28 have a length of less than 10 feet. Inverter 10 can also be a higher power inverter such as an inverter which converts 110V power to generate the display signal.

Switching circuit 16 is generally coupled to a positive power input 12 and a negative power input 14. Switching circuit 16 is also coupled to transformer circuit 20. Transformer circuit 20 is coupled to display tube 24 at an output 21 and display tube 28 at an output 23. Outputs 21 and 23 may be embodied in a single-ended high voltage output having only one high voltage lead and a ground return lead or a floating interface wherein outputs 21 and 23 are not referenced to ground.

Switch control circuit 26 is at least indirectly coupled to transformer circuit 20 or outputs 21 and 23. Alternatively, circuit 26 can be coupled directly to display tubes 24 and 28 or transformer circuit 20. Circuit 26 preferably derives power from inverter 10.

Circuit 26 controls the operation of switches 30 and 32 which are coupled to display tubes 24 and 28. Switches 30 and 32 can be coupled in series or in parallel with tubes 24 and 28. Switches 30 and 32 are preferably reed switches coupled in parallel with tubes 24 and 28 respectively. Switches 30 and 32 generally have low turn ON and turn OFF times despite being mechanical switches to allow efficient and precise control of tubes 24 and 28. Control circuit 26 opens and closes switches 30 and 32 to enable and disable tubes 24 and 28, respectively.

In operation, switching circuit 16 receives a low voltage DC signal (9–14 VDC) across power inputs 12 and 14. Power inputs 12 and 14 may be coupled with a battery, wall adapter, or other DC power source. Switching circuit 16 preferably provides a high frequency DC pulsing signal (oscillating signal) to transformer circuit 20. Transformer circuit 20 steps up the oscillating signal and provides a high voltage AC output signal (e.g., 25 KHz, 500–4,000 VAC) across outputs 21 and 23 to display tubes 24 and 28. Transformer circuit 20 is preferably current limited to prevent effects associated with the closing of switches 30 and 32. Transformer circuit 20 is current limited by designing circuit 20 to have a large inductive reactance. Display tubes 24 and 28 emit light in response to the AC output signal (display signal). Alternatively, the display signal can be a lower frequency signal such as a 60 Hz AC signal. In another alternative, a high power signal such as 110V can be provided at inputs 12–14.

Switching control circuit 26 preferably derives its power from the display signal at display tubes 24 and 28 or transformer circuit 20 and controls switches 30 and 32 to turn ON and OFF display tubes 24 and 28. More particularly, circuit 26 can alternatively provide the display signal to tubes 24 and 28 to provide animated effects. Switches 30 and 32 preferably short circuit tubes 24 and 28 to turn off one of tubes 24 and 28.

Figure 2:
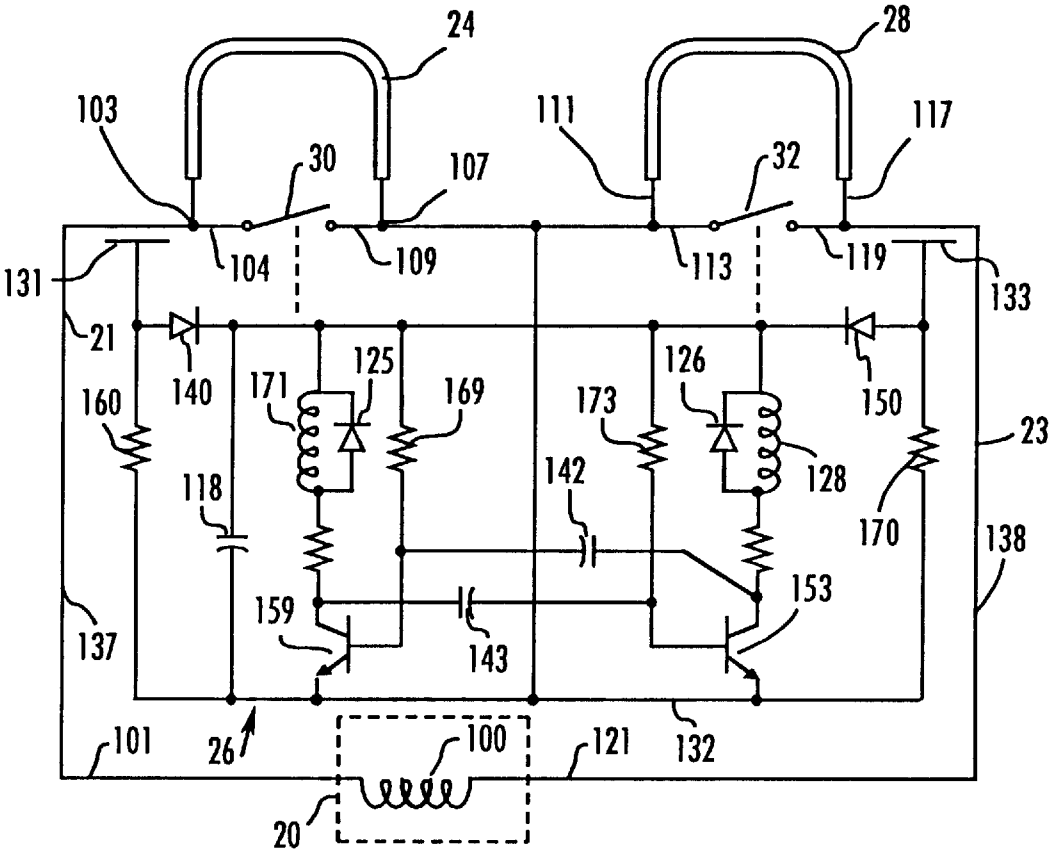
FIG. 2 is an electrical schematic drawing of a portion of the power supply illustrated in FIG. 1 in accordance with a first exemplary embodiment of the present invention.

FIG. 2 is an electrical schematic circuit diagram of a portion of power supply system or inverter 10 including a secondary 100 of transformer circuit 20, mechanical switches 30 and 32 and switch control circuit 26. Secondary 100 of inverter 10 is coupled with display tubes 24 and 28 at outputs 21 and 23. Secondary 100 preferably has a large inductive reactance.

A first end 101 of secondary 100 is coupled to a first end 103 of display tube 24 and a first end 104 of mechanical switch 30. A second end 107 of display tube 24 and a second end 109 of mechanical switch 30 are coupled to a first end 111 of display tube 28 and a first end 113 of mechanical switch 32. A second end 117 of display tube 28 and a second end 119 of mechanical switch 32 are coupled with a second end 121 of secondary 100.

Capacitors 131 and 133 use a high voltage output lead 137 as dielectric and a conductive cylinder to form the plate of capacitor 131 and 133. Capacitor 131 is coupled to an anode terminal of diode 140 and a first end of resistor 160. Capacitor 133 is coupled to an anode terminal of diode 150 and a first end of resistor 170. A second end of resistor 160, a second end of resistor 170, a first end of capacitor 118, an emitter terminal of transistor 159 and an emitter terminal of transistor 153 are coupled to a ground reference 132 in inverter 10.

A second end of capacitor 118, a first end of coil 171, a cathode terminal of diode 125, a first end of resistor 169, a first end of resistor 173, a cathode terminal of diode 126, and a first end of coil 128 are coupled with a cathode terminal of diode 140 and a cathode terminal of diode 150. A second end of coil 171, an anode terminal of diode 125, and a first end of capacitor 143 are coupled with a collector terminal of transistor 159. A second end of coil 128, an anode terminal of diode 126, and a first end of capacitor 142 are coupled with a collector terminal of transistor 153. A second end of resistor 169 and a second end of capacitor 142 are coupled with a base terminal of transistor 159. A second end of resistor 173 and a second end of capacitor 143 are coupled with a base terminal of transistor 153.

In operation, low voltage inverter 10 produces a high voltage, high frequency output. Capacitors 131 and 133 draw current from high voltage output lead 137 and a return lead 138, which is rectified by diodes 140 and 150. The rectified signal is smoothed by capacitor 118 and provided as a DC power signal to circuit 26. Capacitors 131 and 133 are advantageously formed by a cylinder or a wrap of metallic tape around conductors 137 and 138. In this way, a separate power source for circuit 26 is not necessary.

When transistor 153 is in an ON state, one plate of charged capacitor 142 is grounded through the collector terminal of transistor 153. Therefore, the other plate of capacitor 142, coupled with the base terminal of transistor 159, has a low potential and turns transistor 159 OFF. Current is drawn through coil 128 by transistor 153, magnetically activating mechanical switch 32. Mechanical switch 32 closes, shorting out display tube 28. With this arrangement, display tube 24 emits light in response to the display signal, and display tube 28 does not.

When transistor 153 is in an ON state, capacitor 142 charges through resistor 169, raising the potential at the base terminal of transistor 159. When the potential reaches the necessary level, transistor 159 is turned ON. One plate of capacitor 143 is then connected with ground through the collector terminal of transistor 159, creating a low potential at the base terminal of transistor 153 and switching its state from ON to OFF. Current flows through coil 171 via transistor 159, magnetically activating and closing mechanical switch 30. Mechanical switch 32, no longer closed magnetically by a current flowing through coil 128 because transistor 153 is OFF, returns to the open position. Display tube 28 emits light in response to the display signal, while display tube 24 does not.

Capacitor 143 charges through resistor 173, raising the potential at the base terminal of transistor 153. When the potential reaches the necessary level, transistor 153 is turned ON and transistor 159 switches to the OFF state. This cycle repeats so long as low voltage inverter 10 produces a display signal. Thus, circuit 26 activates switches 30 and 32 alternately to provide animated effects. The use of capacitors 131 and 133 allows circuit 26 to be manufactured at a minimal cost. Further, the use of switches 30 and 32 eliminates the need for additional secondaries 100 or inverters 10.

Figure 3:
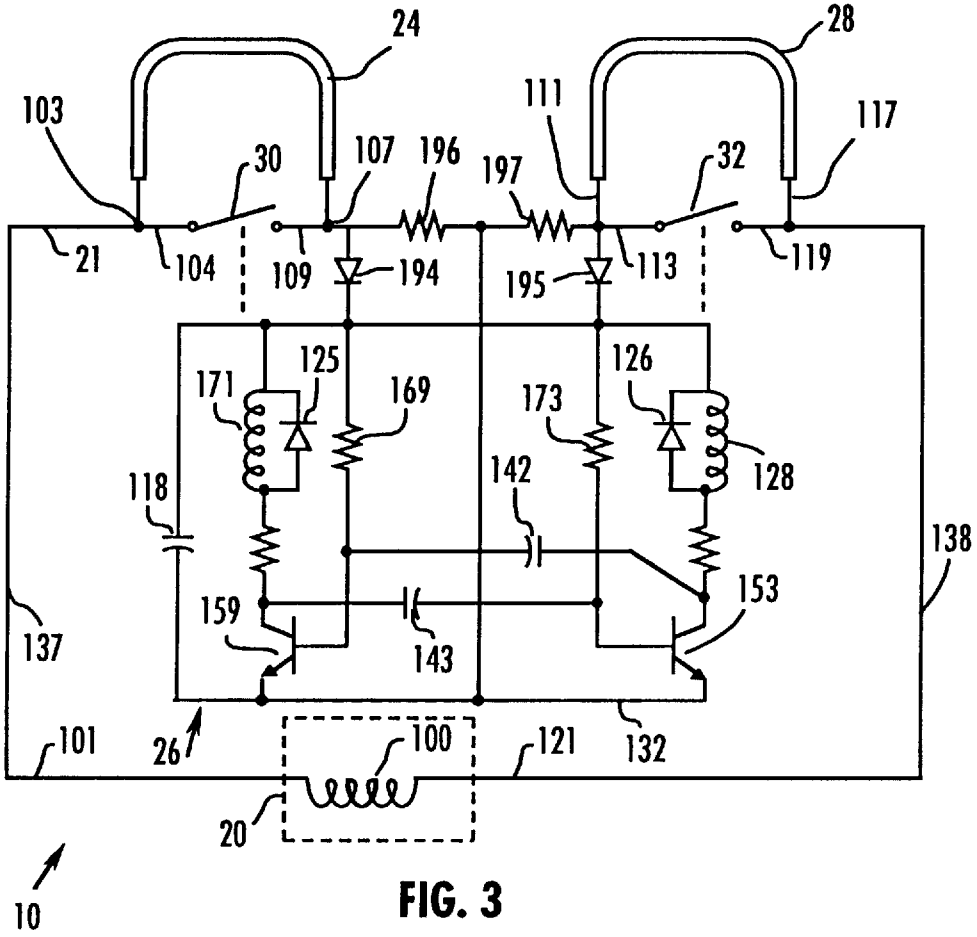
FIG. 3 is an electrical schematic drawing of a portion of the power supply illustrated in FIG. 1 in accordance with a second exemplary embodiment of the present invention.

FIG. 3 is an electrical schematic circuit diagram of a portion of power supply system or inverter 10 including a secondary 100 of transformer circuit 20, mechanical switches 30 and 32, and a control circuit 26. Inverter 10 is coupled with display tubes 24 and 28.

A first end 101 of secondary 100 is coupled to a first end 103 of display tube 24 and a first end 104 of mechanical switch 30. A second end 107 of display tube 24 and a second end 109 of mechanical switch 30 are coupled with a first end resistor 196 and an anode terminal of diode 194. A first end of resistor 197 is coupled with a second end of resistor 196, a first end of capacitor 118, an emitter terminal of transistor 159 and an emitter terminal of transistor 153. A second end of resistor 197 is coupled with a first end 111 of display tube 28, a first end 113 of mechanical switch 32 and an anode terminal of diode 195. A second end 117 of display tube 28 and a second end 119 of mechanical switch 32 are coupled with a second end 121 of secondary 100.

A second end of capacitor 118, a first end of a coil 171, a cathode terminal of a diode 125, a first end of resistor 169, a first end of resistor 173, a cathode terminal of diode 126, and a first end of coil 128 are coupled with a cathode terminal of diode 194 and a cathode terminal of diode 195. A second end of coil 171, an anode terminal of diode 125, and a first end of capacitor 143 are coupled with a collector terminal of transistor 159. A second end of coil 128, an anode terminal of diode 126, and a first end of capacitor 142 are coupled with a collector terminal of transistor 153. A second end of resistor 169 and a second end of capacitor 142 are coupled with a base terminal of transistor 159. A second end of resistor 173 and a second end of capacitor 143 are coupled with a base terminal of transistor 153.

Current for control circuit 26 is drawn across resistors 196 and 197 as it travels as the display signal across tubes 24 and 28 and switches 30 and 32. Diodes 194 and 195 rectify the signal from tubes 24 and 25 and capacitor 118 stores charge to provide a filtered and stable power source for circuit 26.

When transistor 153 is in an ON state, one plate of charged capacitor 142 is grounded through the collector terminal of transistor 153. The other plate of capacitor 142 is coupled with the base terminal of transistor 159, has a low potential and turns transistor 159 OFF. Current is drawn through coil 128 by transistor 153, magnetically activating mechanical switch 32. Mechanical switch 32 closes, shorting out display tube 28. With this arrangement, display tube 24 emits light in response to the display signal, while display tube 28 does not.

When transistor 153 is in an ON state, capacitor 142 charges through resistor 169, raising the potential at the base terminal of transistor 159. When the potential reaches the necessary level, transistor 159 is turned ON. One plate of capacitor 143 is then connected with ground through the collector terminal of transistor 159, creating a low potential at the base terminal of transistor 153 and switching its state from ON to OFF. Current flows through coil 171, magnetically activating and closing mechanical switch 30. Mechanical switch 32, no longer closed magnetically by a current flowing through coil 128, returns to the open position. Display tube 28 emits light in response to the display signal, while display tube 24 does not. Capacitor 143 charges through resistor 173, raising the potential at the base terminal of transistor 153. When the potential reaches the necessary level, transistor 153 is turned ON and transistor 159 switches to the OFF state. This cycle repeats so long as low voltage inverter 10 produces a display signal.

Figure 4:
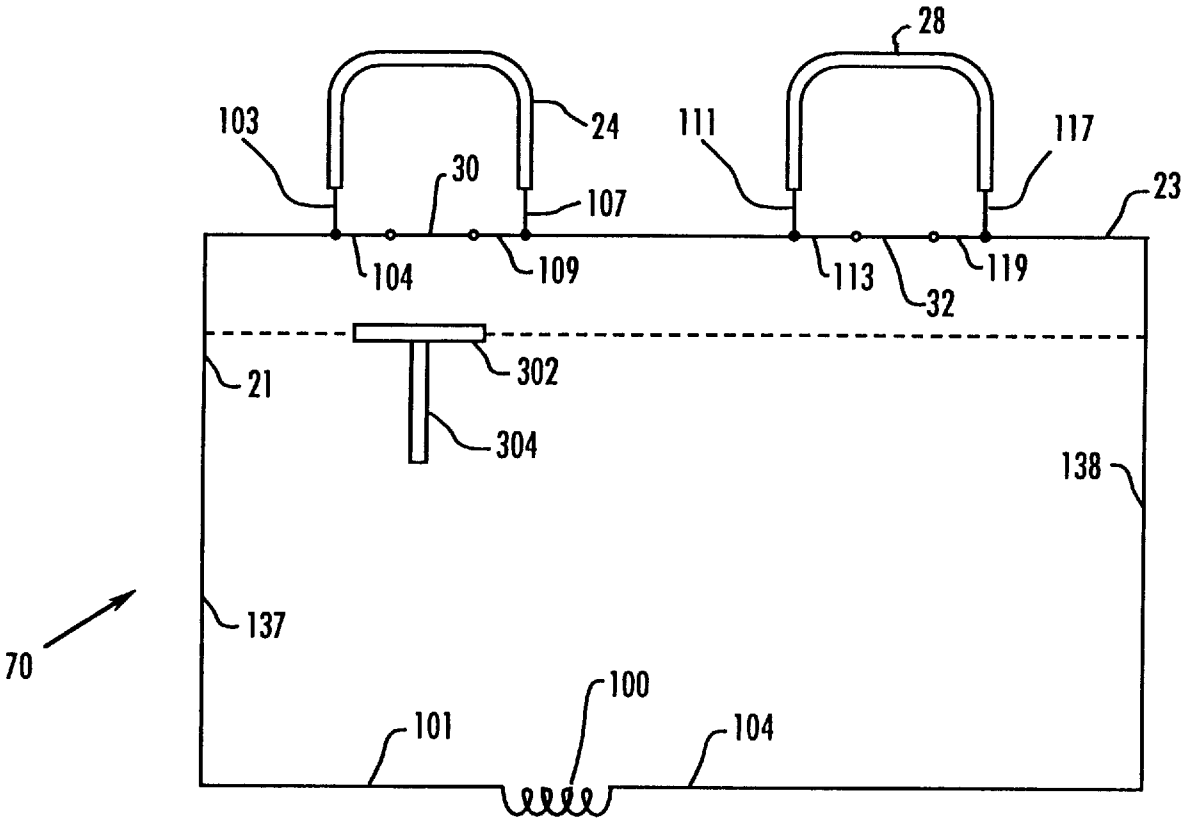
FIG. 4 is a schematic drawing of a portion of the power supply illustrated in FIG. 1 in accordance with a third exemplary embodiment of the present invention.

FIG. 4 is a schematic drawing of a portion of power supply system or inverter 10 including secondary 100, of transformer circuit 20 mechanical switches 30 and 32, a permanent magnet 302 and actuator 304. Power supply system 10 is coupled with display tubes 24 and 28. Preferably, display tubes 24 and 38 are less than 10 feet in length.

A first end 101 of secondary 100 is coupled with a first end 103 of display tube 24 and a first end 104 of mechanical switch 30. A second end 107 of display tube 24 and a second end 109 of mechanical switch 30 are coupled with a first end 111 of display tube 28 and a first end 113 of mechanical switch 32. A second end 117 of display tube 32 and a second end 119 of mechanical switch 32 are coupled with a second end 104 of secondary 100. Permanent magnet 302 is coupled with actuator 304.

In operation, power supply system or inverter 10 provides a display signal to display tubes 24 and 28. Mechanical switches 30 and 32 are closed in their normal state, shorting display tubes 24 and 28. Permanent magnet 302 may be positioned by means of actuator 304 to magnetically open switch 30 or 32. Magnet 302 is preferably disposed adjunct or proximate switches 30 and 32 so magnet 302 can close or open switches 30 and 32. When mechanical switch 30 is open, display tube 24 emits light in response to the display signal, while display tube 28 does not. When mechanical switch 32 is open, display tube 28 emits light in response to the display signal, while display tube 24 does not. The use of magnet 302 allows a simple design of inverter 10 for an OPEN or CLOSED sign which utilizes display tubes. When magnet 302 closes switch 30, tube 28 can indicate an OPEN message. Conversely, when magnet 302 closes switch 32, tube 24 can indicate a CLOSED message.

In another alternative, a low current motor or clock motor (not shown) can be mechanically coupled to magnet 302 to move magnet 302 to create animated effects. The motor can be powered by current derived from secondary 100 as discussed with reference to FIGS. 2 and 3. The motor mechanically alternates the position of magnet 302 to open and close switches 30 and 32.

It is understood that, while the detailed drawings and specific examples given describe preferred exemplary embodiments of the present invention, they are for the purpose of illustration only. The apparatus of the invention is not limited to the precise details and conditions disclosed. For example, although a control circuit employs an astable multivibrator, other logic circuits may be utilized. Also, although two display tubes alternately emitting light are discussed, more display tubes and more complex effects may be used. Various changes may be made to the details disclosed without departing from the spirit of the invention which is defined by the following claims.

What is claimed is:

1. A power supply for use with a plurality of display tubes, the power supply comprising:

a low voltage inverter coupled to a plurality of display tubes, wherein said low voltage inverter provides a display signal to said display tubes;

a plurality of mechanical switches, wherein at least one of said plurality of switches is coupled to at least one of said plurality of display tubes and at least an additional one of said plurality of switches is coupled to at least an additional one of said plurality of display tubes, whereby application of the display signal from said low voltage inverter to said at least one of said plurality of display tubes is determined by operation of said at least one of said plurality of switches and whereby application of the display signal from said low voltage inverter to said at least an additional one of said plurality of display tubes is determined by operation of said at least an additional one of said plurality of switches;

a control circuit coupled to said low voltage inverter and said at least one and said at least an additional one of said plurality of mechanical switches, said control circuit operating to activate each of said at least one and said at least an additional one of said mechanical switches; and wherein the display signal is provided on a display lead and the control circuit is powered by a capacitor coupled to the display lead.

2. The power supply of claim 1, wherein said at least one and said at least an additional one of said plurality of mechanical switches are reed switches.

3. The power supply of claim 2 wherein the control circuit is coupled to coils disposed adjacent the reed switches.

4. The power supply of claim 1, wherein said control circuit is an astable multivibrator.

5. The power supply of claim 1, wherein said control circuit is a magnetic circuit which includes a mechanical actuator.

6. The power supply of claim 1 wherein the capacitor is a conductive material disposed around the display lead.

7. The power supply of claim 1 wherein the display lead is coupled in series with said at least one and said at least an additional one of said plurality of display tubes and the at least one and said at least an additional one of said plurality of mechanical switches are reed switches, each of the reed switches being coupled in parallel with its respective display tube.

8. The power supply of claim 7 wherein a return lead is coupled to a last one of the display tubes and a capacitor is coupled to the return lead.

9. The power supply of claim 8 wherein the capacitor is a conductive material disposed around the return lead.

10. A power supply for use with a plurality of display tubes, the power supply comprising:

a low voltage inverter coupled to the plurality of display tubes, wherein said low voltage inverter provides a display signal to said display tubes;

a plurality of mechanical switches, at least one of said plurality of switches being coupled to an at least one of said display tubes, and at least an additional one of said plurality of switches being coupled to an at least an additional one of said plurality of display tubes, wherein the display signal is provided from said low voltage inverter to one of said display tubes as controlled by said switches and wherein the display signal is provided on a display lead; and a magnetic device disposed proximate said switches, wherein said magnetic device is a magnetic coil and wherein a control circuit provides current to said coil, wherein the control circuit is powered by a capacitor coupled to the display lead, said magnetic device operating to open and close said switches, thereby turning ON and OFF said display tubes.

11. The power supply of claim 10 further comprising:

an actuator coupled to said magnetic device, said magnetic device including a permanent magnet, said actuator operable to activate each of said mechanical switches by positioning of said permanent magnet.

12. The power supply of claim 10, wherein said mechanical switches are reed switches.

13. The power supply of claim 10 wherein the capacitor is a conductive material disposed around the display lead.

14. The power supply of claim 10 wherein the mechanical switches are reed switches, each of the reed switches being coupled in parallel with said each of the reed switches respective display tube.

15. A voltage inverter power supply for use with a first display tube and a second display tube, the power supply comprising:

a transformer having a secondary winding with a first terminal and a second terminal, the first display tube being coupled in series with the second display tube, the first display tube being coupled to the first terminal and the second display tube is coupled to the second terminal, wherein said transformer provides a display signal to the first terminal;

a first reed switch coupled in parallel with said first display tube;

a second reed switch coupled in parallel with said second display tube, wherein the display signal is provided from said secondary winding of said transformer to said first display tube or said second display tube; and a control circuit magnetically coupled to said first reed switch and said second reed switch, said control circuit operating to open and close said first reed switch or said second reed switch, thereby turning ON and OFF said first display tube or said second display tube wherein the control circuit is powered by a capacitor coupled around a wire coupled to the first terminal.

16. The power supply of claim 15 wherein the control circuit includes a permanent magnet.

* * * * *